US012351381B2

(12) United States Patent
Page

(10) Patent No.: US 12,351,381 B2
(45) Date of Patent: Jul. 8, 2025

(54) REHYDRATION DEVICE

(71) Applicant: Monkey Wolf, LLC, North Little Rock, AR (US)

(72) Inventor: Jack Paul Page, North Little Rock, AR (US)

(73) Assignee: Monkey Wolf, LLC

( * ) Notice: Subject to any disclaimer, the term of this patent is extended or adjusted under 35 U.S.C. 154(b) by 91 days.

(21) Appl. No.: 17/823,399

(22) Filed: Aug. 30, 2022

(65) Prior Publication Data

US 2024/0067433 A1 Feb. 29, 2024

(51) Int. Cl.

| | |
|---|---|
| ***B65D 81/22*** | (2006.01) |
| ***A24B 3/04*** | (2006.01) |
| ***A24F 25/00*** | (2006.01) |
| ***B65D 6/00*** | (2006.01) |
| ***B65D 6/24*** | (2006.01) |
| ***B65D 43/16*** | (2006.01) |
| ***B65D 43/22*** | (2006.01) |
| ***B65D 65/46*** | (2006.01) |

(52) U.S. Cl.

CPC ..... *B65D 81/22* (2013.01); *A24B 3/04* (2013.01); *A24F 25/00* (2013.01); *B65D 11/10* (2013.01); *B65D 11/188* (2013.01); *B65D 43/163* (2013.01); *B65D 43/22* (2013.01); *B65D 65/466* (2013.01)

(58) Field of Classification Search

CPC ..... B65D 81/22; B65D 11/10; B65D 11/188; B65D 43/163; B65D 43/22; B65D 65/466; A24B 3/04; A24F 25/00

USPC ..... 206/204–205, 242, 525, 521.1; 220/913, 220/324, 4.23, 839, 212, 366.1, 4.22, 220/4.24, 526, 556, 676, 735, 810; 428/137, 326, 36.1, 913, 284, 286; 442/290, 389, 393, 72, 76; 139/420 R

See application file for complete search history.

(56) References Cited

U.S. PATENT DOCUMENTS 977,374 A * 11/1910 De Lano ..... A61L 9/12 239/54
1,481,971 A * 1/1924 Whiting ..... B65D 81/267 95/91
1,556,951 A * 10/1925 Marshall ..... A24F 23/02 252/194
1,598,557 A * 8/1926 Clark ..... A24F 25/02 312/31.1

(Continued)

*Primary Examiner* — Orlando E Aviles
*Assistant Examiner* — Brijesh V. Patel
(74) *Attorney, Agent, or Firm* — Briggs Intellectual Prope; Jeremy A. Briggs

(57) ABSTRACT

A rehydration device configured to be placed in a storage box is described. The rehydration device includes a first part and a second part. The first part and the second part may be connected via a hinge at a first portion about which the first part and the second part rotate. The first part and the second part may hold a piece of woven hemp fabric. The piece of woven hemp fabric may be configured to maintain a predetermined humidity level in the storage device. The rehydration device further includes a locking mechanism located along a periphery of the first part and the second part, to removably couple the first part and the second part in a closed position. The rehydration device further includes one or more openings to allow water vapors from the hemp fabric to flow out of the rehydration device.

18 Claims, 6 Drawing Sheets

(56) References Cited

U.S. PATENT DOCUMENTS 1,871,418 A * 8/1932 McKee ..... A24F 25/02 96/118
2,020,534 A * 11/1935 Brown ..... B65D 5/5028 229/906
2,270,603 A * 1/1942 Ridder ..... A24F 25/02 239/57
2,365,185 A * 12/1944 Gailey ..... A24F 25/02 239/57
2,928,537 A * 3/1960 Stagner ..... B65D 85/60 426/410
2,958,469 A * 11/1960 Shuster ..... F26B 21/083 239/57
3,924,807 A * 12/1975 Morgan ..... F24F 6/04 261/DIG. 14
4,008,930 A * 2/1977 Swainson ..... A24F 25/02 312/31.1
4,108,598 A * 8/1978 Payet ..... D06M 13/127 8/115.7
4,161,549 A * 7/1979 Ohno ..... A23F 5/02 426/456
4,260,060 A * 4/1981 Faller ..... B65D 81/3453 229/123.1
4,528,228 A * 7/1985 Clevenger ..... B05C 19/04 206/521.1
4,749,392 A * 6/1988 Aoki ..... B01J 20/28033 55/513
4,995,556 A * 2/1991 Arnold, III ..... A61L 9/12 422/123
5,037,459 A * 8/1991 Spruill ..... B65D 81/24 426/118
5,425,975 A * 6/1995 Koiso ..... C09K 5/16 428/137
D361,035 S * 8/1995 Krupa ..... D9/425
5,456,379 A * 10/1995 Krupa ..... B65D 43/162 206/508
D363,879 S * 11/1995 Krupa ..... D9/425
5,472,139 A * 12/1995 Valdman ..... B65D 1/34 229/407
5,501,141 A * 3/1996 Mendez ..... A47J 36/24 220/4.23
D378,192 S * 2/1997 Krupa ..... D9/425
5,711,978 A * 1/1998 Breen ..... B65B 25/067 426/106
5,820,955 A * 10/1998 Brander ..... B65D 81/264 428/36.1
5,860,528 A * 1/1999 Emery ..... B65D 85/32 206/521.1
5,934,458 A * 8/1999 Duron ..... A47J 47/10 206/204
5,944,306 A * 8/1999 Maeda ..... B65H 1/266 206/455
5,947,321 A * 9/1999 Vadney ..... B65D 51/1611 220/326
5,975,288 A * 11/1999 Crowder ..... A24F 25/02 206/242
6,006,903 A * 12/1999 Milone ..... A24F 15/20 312/271
6,047,819 A * 4/2000 Borst ..... B65D 43/162 206/459.5
6,095,324 A * 8/2000 Mullin ..... B65D 85/36 206/204
6,106,775 A * 8/2000 Fuller ..... A23B 2/704 422/123
6,119,855 A * 9/2000 Yeager ..... B32B 3/04 206/213.1
6,245,230 B1 * 6/2001 Ricci ..... C02F 1/705 210/232
D512,633 S * 12/2005 Sambrailo ..... B65D 43/162 D9/434
7,591,369 B2 * 9/2009 Lin ..... A63B 67/18 239/57
8,033,391 B1 * 10/2011 D'Abusco ..... B65D 81/264 229/906
8,167,166 B2 * 5/2012 Kidd ..... B65D 81/263 220/4.23
8,211,209 B2 * 7/2012 Neff ..... B65D 85/12 55/516
8,651,279 B2 * 2/2014 Malone ..... B65D 25/08 206/541
8,748,723 B1 * 6/2014 Egberg ..... B01D 53/28 261/99
8,960,480 B2 * 2/2015 Clark ..... B65D 1/36 220/521
8,985,382 B2 * 3/2015 Vernon ..... B65D 81/3216 206/508
9,469,458 B2 * 10/2016 Padda ..... B65D 43/16
9,511,901 B2 * 12/2016 Lam ..... B65D 85/34
9,580,234 B2 * 2/2017 Lam ..... B65D 43/162
9,814,330 B2 * 11/2017 DiMeo ..... B65D 43/163
10,518,955 B2 * 12/2019 Kuhlman ..... B65D 81/22
2001/0002268 A1 * 5/2001 Hanson ..... B65D 43/162 426/106
2003/0152670 A1 * 8/2003 Shih ..... B65D 43/162 426/106
2006/0097223 A1 * 5/2006 Powers ..... B01J 20/045 252/194
2006/0144726 A1 * 7/2006 Foust ..... B65D 81/266 206/204
2007/0007293 A1 * 1/2007 Sambrailo ..... B65D 81/18 220/366.1
2007/0056980 A1 * 3/2007 Sambrailo ..... B65D 43/162 220/592.01
2007/0193891 A1 * 8/2007 Portier ..... B65D 79/02 206/459.1
2008/0199577 A1 * 8/2008 Jensen ..... A47J 47/10 428/68
2009/0223966 A1 * 9/2009 Kidd ..... B65D 75/22 220/324
2010/0258574 A1 * 10/2010 Bentley ..... B65D 81/3823 220/592.2
2011/0233077 A1 * 9/2011 Cadiente ..... B65D 81/263 206/204
2012/0067270 A1 * 3/2012 Huynh ..... G01N 31/222 116/206
2013/0091618 A1 * 4/2013 Tanaka ..... A41D 19/01558 2/161.8
2013/0153081 A1 * 6/2013 Garbarino ..... B32B 5/26 139/420 R
2013/0217284 A1 * 8/2013 Wang ..... D03D 15/225 442/76
2013/0334074 A1 * 12/2013 Wada ..... B65D 55/16 206/204
2014/0216956 A1 * 8/2014 Ott ..... B65D 21/0202 206/251
2015/0328584 A1 * 11/2015 Egberg ..... B01D 53/28 428/35.2
2015/0335497 A1 * 11/2015 Montford ..... A61F 13/141 604/385.14
2016/0101916 A1 * 4/2016 Grijalva Varillas ... B65D 31/02 383/102
2016/0122117 A1 * 5/2016 Moore ..... B65D 55/0818 206/204
2018/0099804 A1 * 4/2018 Esse ..... B65D 81/18
2020/0039723 A1 * 2/2020 Knutsen ..... B65D 81/18
2020/0165544 A1 * 5/2020 Stern ..... D06M 16/00
2021/0188519 A1 * 6/2021 Riley ..... B65D 81/2076
2021/0262132 A1 * 8/2021 George ..... D04H 1/43835
2022/0403601 A1 * 12/2022 Cartier ..... B65D 65/466

* cited by examiner

REHYDRATION DEVICE

TECHNICAL FIELD

The present disclosure relates to a rehydration device, and more specifically to a rehydration device that maintains a predetermined humidity level within an enclosed environment by using a hemp cloth.

BACKGROUND

Perishable items typically require a specific humidity level to keep their moisture intact and increase shelf life. Examples of such items include, but are not limited to, tobacco products (e.g., cigars), food products, medicines, herbs, and the like. Conventionally, such items are placed inside a humidor that maintains humidity level inside the humidor.

Typically, a humidor includes one or more humidity control products (or humidifiers) that release moisture to maintain humidity inside the humidor. For instance, cigar boxes conventionally use humidity control products to maintain moisture level of cigars and preserve the cigars for a long duration.

Conventional humidors use silica beads or crystal gels to release moisture in the humidor to control the humidity level. Since silica beads and crystal gels deteriorate over time, the conventional humidors are single-use products that lose their moisture content over time. In addition, conventional humidors are made from materials that are non-biodegradable, and hazardous to the environment.

Thus, there is a need for a rechargeable and an environment-friendly humidity control device.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1A:
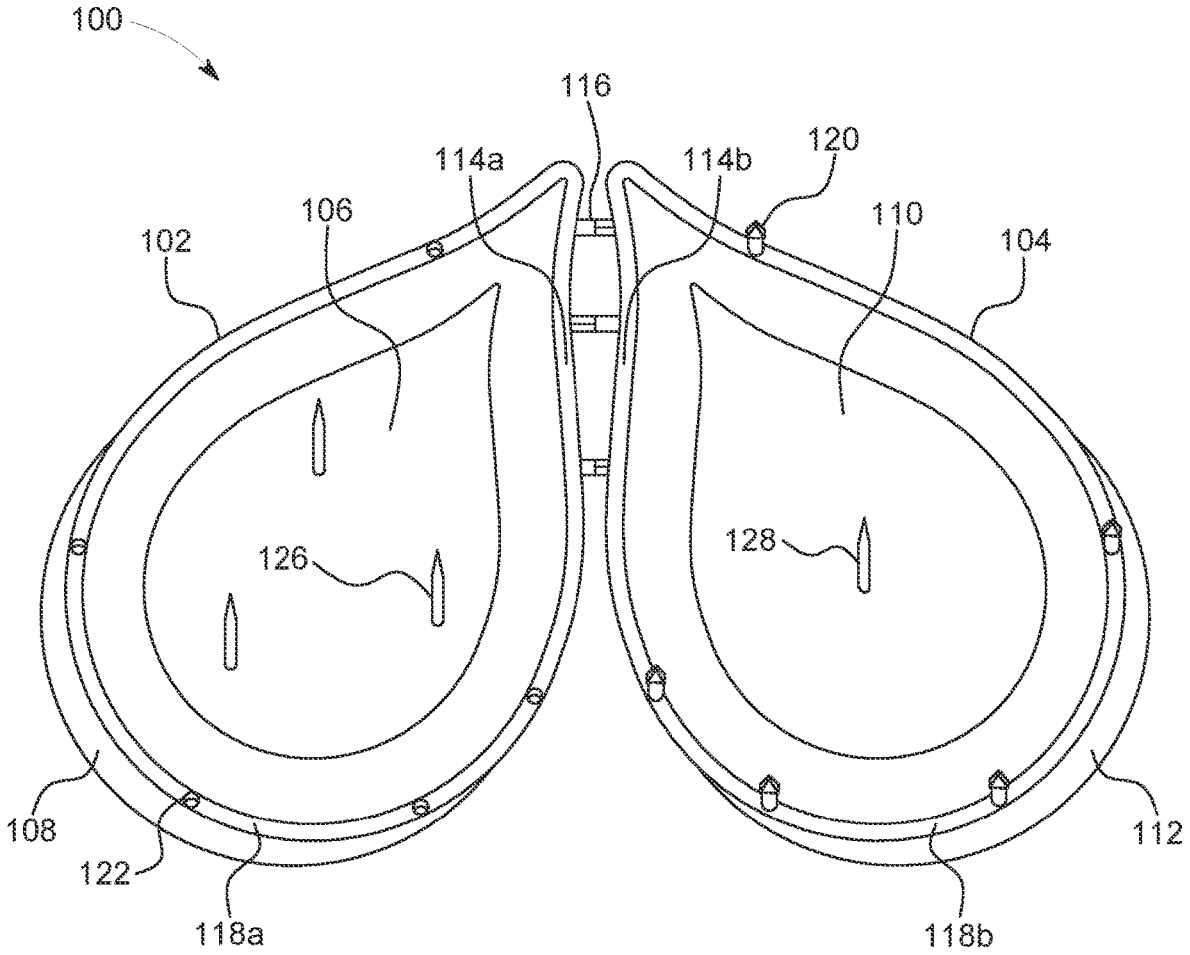
FIGS. 1*a* and 1*b* depict a first view of an example rehydration device, in accordance with the present disclosure.

The present disclosure is directed towards a rehydration device that may be placed in a storage container containing one or more items (e.g., a cigar box containing cigars). The rehydration device may help maintain a predefined humidity level in the container. The rehydration device may include two parts, e.g., a first part and a second part, that may be rotatably coupled with each other via a hinge. The rehydration device may further include a locking mechanism to lock the first part and the second part in a closed position. In some aspects, the first part and the second part may enclose a hemp fabric, when the first and the second parts lock in the closed position. The hemp fabric may be configured to release water vapors to maintain the predefined humidity level in the storage container. In some aspects, the first part and the second part may include one or more openings to enable the release of the water vapors from the hemp fabric to the storage container.

In some aspects of the present disclosure, the rehydration device may be a unified piece made of biodegradable plastic. Further, the rehydration device may be rechargeable by using water. In other words, the hemp fabric may be rehydrated multiple times, to maintain a predefined moisture level in the fabric. In one or more aspects, the hemp fabric may be anti-fungal and anti-bacterial, to enable the use of the hemp fabric multiple times, with minimal deterioration.

In one or more aspects, the rehydration device may include one or more retention components, placed in interior portions of the first part and the second part, to secure the hemp fabric inside the rehydration device. The retention components may include, for example, securing pins or barbs. The rehydration device encloses the hemp fabric in an enclosed inner portion formed by the first part and the second part, thereby minimizing direct contact of the hemp fabric (containing the moisture) with the one or more items such as, for example, cigars, loose leaf tobacco, or other smokable media placed in the storage container.

The present disclosure offers various advantages over conventional humidity control devices. For instance, the rehydration device is rechargeable by using water, and hence may be used multiple times. Further, the hemp fabric enclosed in the rehydration device is anti-fungal and anti-bacterial, and hence has a long shelf life. In addition, the anti-fungal and anti-bacterial properties of the hemp fabric may mitigate contamination of the one or more items placed in the storage container. Moreover, the anti-fungal and anti-bacterial properties of the hemp rehydration device may also mitigate cross-contamination of biological matter from one quantity of smokable media to a second quantity. Furthermore, the rehydration device may be constructed from environment-friendly biodegradable plastic, such as hemp-based plastic material.

These and other advantages of the present disclosure are provided in detail herein.

Illustrative Embodiments

The disclosure will be described more fully hereinafter with reference to the accompanying drawings, in which example embodiments of the disclosure are shown, and not intended to be limiting.

Figure 1B:
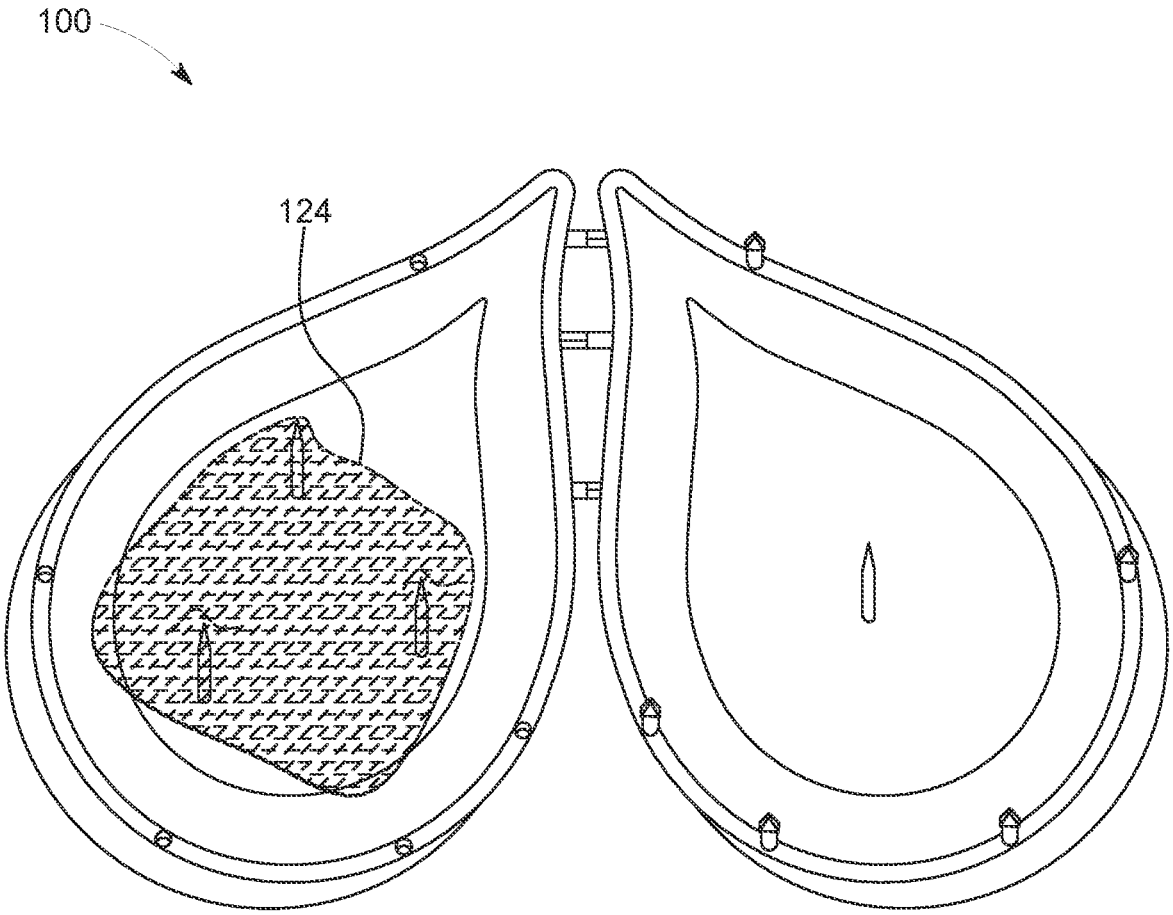

The rehydration device 100 may include a first part 102 having a mirrored FIGS. 1*a* and 1*b* depict a first view of an example rehydration device 100, in accordance with the present disclosure. In particular, FIGS. 1*a* and 1*b* depict an open position of the rehydration device 100. In accordance with some aspects of the present disclosure, the rehydration device 100 may be placed inside a sealable or non-sealable enclosed storage container (not shown) in conjunction with smokable media to maintain a level of humidity inside the storage bin, and thus, to rehydrate or maintain hydration of the smokable media. Specifically, the rehydration device 100 may configured to maintain a moisture level of one or more items (not shown) that are placed in the storage bin, such as cigars, tobacco, or other material. In some aspects, the rehydration device 100 may be placed in a proximity of the one or more items.

In one or more aspects, the storage bin (or storage device) may include a cigar box (or a cigar humidor) or a box to store tobacco products. In other aspects, the storage device may be used to control relative humidity for other dry goods. For example, the rehydration device 100 may be used in enclosed areas that store food products, spices, medicines, herbs, clothing, apparel, sports equipment, artwork, electronic items, musical instruments, printing inks or paints, and the like.

In some aspects, the storage device may include one or more compartments to place the one or more items and the rehydration device 100. The rehydration device 100 may be removably attached to the storage device using retention or support means (not shown) in the one or more compartments. Retention or support means may include, for example, tape, a strap, a hook and loop fastener, a retaining clip, a snap, removable adhesive, or other retention or support means. Alternatively, the rehydration device 100 may be placed near or on the one or more items. In other aspects, the rehydration device 100 may be affixed on a lid or cover of the storage device.

In accordance with one or more aspects of the present disclosure, the rehydration device 100 may be a unified structure (e.g., the rehydration device 100 is constructed as a single unit having injection molded features that can include one or more integrated hinges). In other aspects, the rehydration device 100 may include multiple pieces coupled with each other, where an integrated hinge is not included as an integral portion of the rehydration device, and the interlocking halves of the device fit together with via snap feature (not shown in FIG. 1) that may provide a re-openable closure of the rehydration device 100 halves (e.g., the first portion 102 and the second portion 104, respectively. In an example embodiment, the rehydration device 100 may be fabricated using any known manufacturing technique, including injection molding, die stamping, vacuum forming, or other one or more other methods for forming plasticized materials. The rehydration device 100 may be constructed of materials that can include a thermoplastic material or a thermoset material. Example construction materials can include, for example, polyethylene terephthalate, high-density polyethylene, low-density polyethylene, or other similar materials. In other aspects, the device 100 may be constructed of metallic sheets that are die stamped to form the body of the device.

In another preferred embodiment, the rehydration device 100 is composed of a bio-based resin such as hemp biocomposite or hemp plasticized materials made from moldable bioplastic.

Further, the rehydration device 100 may be of any shape, for example a hemispherical shape or a drop-like shape (as shown in FIG. 1*a*). In other aspects, the rehydration device 100 may be of any other shape such as circular, square, rectangular, prism, triangular, hexagonal, tubular, and the like. The shape of the rehydration device 100 may be based on the shape of the storage device in which the rehydration device 100 is to be placed.

In accordance with some aspects of the present disclosure, the rehydration device 100 may be of any size. In one or more aspects, the width of the rehydration device 100 may be approximately one inch and the length may be approximately one inch in diameter (e.g., 1. inch, 1.2 inches, 1.25 inches, etc.). In other aspects, the width and/or length of the rehydration device 100 may be greater or less than one inch. The size of the rehydration device 100 may be based on the size of the storage device, so that the rehydration device 100 can easily fit inside the storage device. For example, a tear-shaped device as shown in FIGS. 1-5 may be used inside of (in one or more interior portions of) cylindrical storage devices, in rectangular storage devices, or other shapes having an interior portion suited for the shape and dimensions of the device 100. In another example, the rehydration device 100 may include a generally rectangular or square form (not shown in FIG. 1), where the device 100 may lay flat or generally flat on a base of the storage device (base not shown in FIG. 1) such that a shallow cavity portion can enclose the hydration device 100 while allowing the storage device lid (not shown in FIG. 1) to close securely, making an airtight (or generally air-sealed) closure. Other shapes are possible and such shapes are contemplated herein.

In accordance with one or more aspects of the present disclosure, the rehydration device 100 may include a first part 102 disposed in connection with a second part 104 via one or more hinges 116. The first part 102 and the second part 104 may have similar characteristics, e.g., shape, size, material, etc. The first part 102 and the second part 104 may act as a cover of the rehydration device 100. In some aspects, the first part 102 and the second part 104 may be made of biodegradable plastic.

The first part 102 may include a body portion that includes a first interior portion 106 and a first exterior portion 108. Similarly, the second part 104 may include a body portion that includes a second interior portion 110 and a second exterior portion 112. In one or more aspects, the first part 102 and the second part 104 may be hinged together at first peripheral portions 114*a* and 114*b*, via the hinge 116. The first part 102 and the second part 104 may be configured to rotate about the hinge 116 as the hinge(s) 116 flex and deform such that the first part 102 seals against a matching surface 118*b* disposed on the second part 104. Specifically, the first part 102 and the second part 104 may be coupled together by a vertical hinge 116. In some aspects, the hinge 116 may be made of any suitable material, such as biodegradable plastic, polymer, metal, and the like. In a preferred embodiment of the present disclosure, the hinge 116 may be made of the same material as the first part 102 and the second part 104, e.g., biodegradable plastic, and may be injection molded to be integral with the first part 102 and the second part 104 such that the respective parts 102 and 104 are joined by the hinge 116 at one or more hinge connection points.

In accordance with one or more aspects of the present disclosure, the first part 102 and the second part 104 may include a locking mechanism, including, for example, a fin connection, a pin connection, an alignment bar, or other locking means. In some aspects, the locking mechanism may be located at second peripheral portions 118*a*, 118*b* of the first part 102 and the second part 104. In particular, the locking mechanism may include a plurality of fins 120 (or pins 120) located at the second peripheral portion 118*b* of the second part 104. Further, the locking mechanism may include a plurality of holes 122 corresponding to the plurality of fins 120, located at the second peripheral portion 118*a* of the first part 102. In particular, the plurality of holes 122 may be configured to receive the plurality of fins 120 to lock the first part 102 with the second part 104, when the first part 102 and the second part 104 rotate about the hinge 116 to secure the rehydration device 100 in a closed position. In other aspects, the plurality of fins 120 may be located at the second peripheral portion 118*a*, and the plurality of holes 122 may be located at the second peripheral portion 118*b*. The plurality of fins 120 may be equal to the plurality of holes 122. In an example embodiment, the second peripheral portion 118*b* may include five fins, and the second peripheral portion 118*a* may include 5 holes.

In some aspects, the plurality of fins 120 may be placed in an equidistant arrangement. Alternatively, the plurality of fins 120 may be placed at varied distances from each other. Similarly, the corresponding plurality of holes 122 may be placed at equal or varied distances from each other.

In accordance with further aspects of the present disclosure, the first part 102 and the second part 104 may be configured to enclose a piece of fabric 124, as shown in FIG. 1*b*. The fabric 124 may be a woven hemp fabric that may be made by using fibers from the stalks of *Cannabis sativa* plant. The hemp fabric 124 may be hydrophilic, with moisture content ranging from 5 to 10% of weight. In particular, the hemp fabric 124 may absorb and retain water, however the hemp fabric 124 may not absorb considerable amount of water (e.g., as compared to cotton). The hemp fabric 124 may have more tensile strength and be more flexible than cotton. Further, the hemp fabric 124 may be biodegradable, and hence environment friendly fabric. In addition, the hemp fabric 124 may be anti-fungal and anti-bacterial.

In one or more aspects, the hemp fabric 124 may be configured to control the humidity level of the storage device (in which the rehydration device 100 is placed) or maintain a predetermined humidity level in the storage device. In particular, the hemp fabric 124 may be configured to maintain the predetermined humidity level by releasing moisture or water vapors in the storage device.

In some aspects, the rehydration device 100 may include multiple layers of hemp fabric 124 to retain more moisture level, thereby maintaining the predetermined humidity level for a longer time duration. Similarly, the rehydration device 100 may include multiple folds of the hemp fabric 124 to retain more moisture level. In some aspects, the number of hemp fabric layers or folds may be based on the application area of the rehydration device 100 or based on the type of the one or more items that are placed in the storage device.

In some aspects, the hemp fabric 124 may retain absorb and moisture when water is added to the hemp fabric 124 (e.g., when the hemp fabric 124 is hydrated). In accordance with some aspects of the present disclosure, the hemp fabric 124 may be re-hydrated by adding more water at a predetermined frequency to maintain the predetermined humidity. Thus, the rehydration device 100 is rechargeable. In other words, the rehydration device 100 may be re-used multiple times, by adding water to the hemp fabric 124 to replenish the fabric moisture.

In accordance with further aspects of the present disclosure, the hemp fabric 124 may be square in shape. In other aspects, the hemp fabric 124 may be of any other shape including, but not limited to, circular, triangular, hexagonal, and the like. The shape of the hemp fabric 124 may be based on the shape of the rehydration device 100.

In some aspects, the hemp fabric 124 may be of any size. For instance, the size of the hemp fabric 124 may be 70% of the rehydration device size (such as 0.7 inch). The size of the hemp fabric 124 may be based on the rehydration device size.

In accordance with further embodiments of the present disclosure, the rehydration device 100 may include one or more retention components (first retention components 126 and second retention components 128) to retain the hemp fabric 124 in the rehydration device 100. In particular, each of the first interior portion 106 and the second interior portion 110 may include the one or more retention components 126, 128 to retain/hold the hemp fabric 124, and prevent movement of the hemp fabric 124 in the rehydration device 100. The one or more retention components 126, 128 may include, but are not limited to, barbs, securing pins, and the like.

In accordance with an aspect, the one or more retention components 126, 128 may include securing pins. Each of the securing pins may include a proximate end and a distal end. The distal ends may be engaged with the first interior portion 106 and the second interior portion 110. The proximate ends may be engaged with the hemp fabric 124 to secure the hemp fabric 124 inside the rehydration device 100. In some aspects, each proximate end may include a spike to secure the hemp fabric 124. In other words, each securing pin may include a protruding spike or a needle. In one or more aspects, the length and thickness of the proximate end and the distal end may be the same. In other aspects, the length and thickness of the proximate end and the distal end may be different. In some aspects, the length of the proximate end may be greater than the length of the distal end. For example, the length of the proximate end (e.g., the length of the spike) may be 60%-75% of the length of the securing pin. Such proportion of the length may allow robust securing of the hemp fabric 124 inside the rehydration device 100.

In some aspects, the first interior portion 106 may include the one or more retention components 126 that may be arranged in a predetermined pattern. For instance, the first interior portion 106 may include three retention components 126 (e.g., three securing pins), as shown in FIG. 1*a*. The retention components 126 may be arranged in a triangular pattern (or any other pattern). In some aspects, the retention components 126 may be placed at an equal distance (predetermined distance) from each other. In other aspects, there may be more or less number of retention components in the first interior portion 106. For instance, there may be six retention components, which may be arranged in a concentric circles or triangles. In other aspects, the first interior portion 106 may include a single retention component that may be placed at a center position or any other position.

In further aspects of the present disclosure, the second interior portion 110 may include the one or more retention components 128 that may be arranged in a predetermined pattern. In particular, the one or more retention components 128 may be arranged based on the arrangement of the one or more retention components 126. Alternatively, the one or more retention components 126 may be arranged based on the arrangement of the one or more retention components 128. For instance, the second interior portion 110 may include a single retention component, as shown in FIG. 1*a*, that may be placed at a center position (or any other position) of the second interior portion 110. The single retention component may be placed such that the one or more retention components 126 (such as the three retention components 126 shown in FIG. 1*a*) may surround the single retention component of the second interior portion 110, to hold or retain the hemp fabric 124.

In some aspects, the number of the one or more retention components 126 may be different from the one or more retention components 128. In other aspects, the number of the one or more retention components 126 may be same as the one or more retention components 128.

In some aspects, the first exterior portion 108 and the second exterior portion 112 may be configured to separate the hemp fabric 124 from the one or more items placed in the storage device. In other words, the first exterior portion 108 and the second exterior portion 112 prevent touching of the hemp fabric 124 with the one or more items, thereby preventing damage of the one or more items, which may be caused due to water content in the hemp fabric 124. Similarly, the separation prevents damage of the hemp fabric 124.

Figure 2:
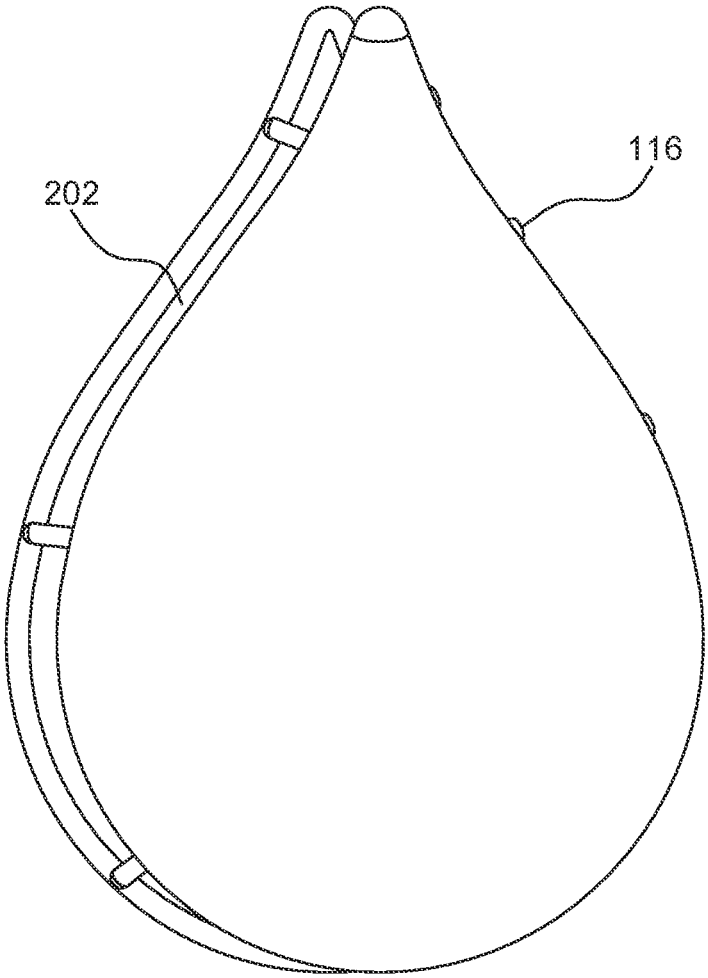
FIG. 2 depicts a second view of the rehydration device, in accordance with the present disclosure.

FIG. 2 depicts a second view of the rehydration device 100, in accordance with the present disclosure. Specifically, FIG. 2 depicts a view of the rehydration device 100 in a closed position.

In accordance with one or more aspects of the present disclosure, the plurality of fins 120 may be engaged with the plurality of holes 122 to lock or close the rehydration device 100, as described above in conjunction with FIG. 1*a*. The rehydration device 100 in the closed position is shown in FIG. 2. In some aspects, in the closed position of the rehydration device 100 (e.g., when the plurality of fins 120 are engaged in the plurality of holes 122), a gap 202 (or an opening 202) may exist between the respective second peripheral portions 118*a* and 118*b*. The gap 202 may allow water vapors from the hemp fabric 124 to release from the rehydration device 100, into the storage device in which the rehydration device 100 may be placed. The release of the water vapors helps maintain a predetermined humidity level in the storage device.

Figure 3:
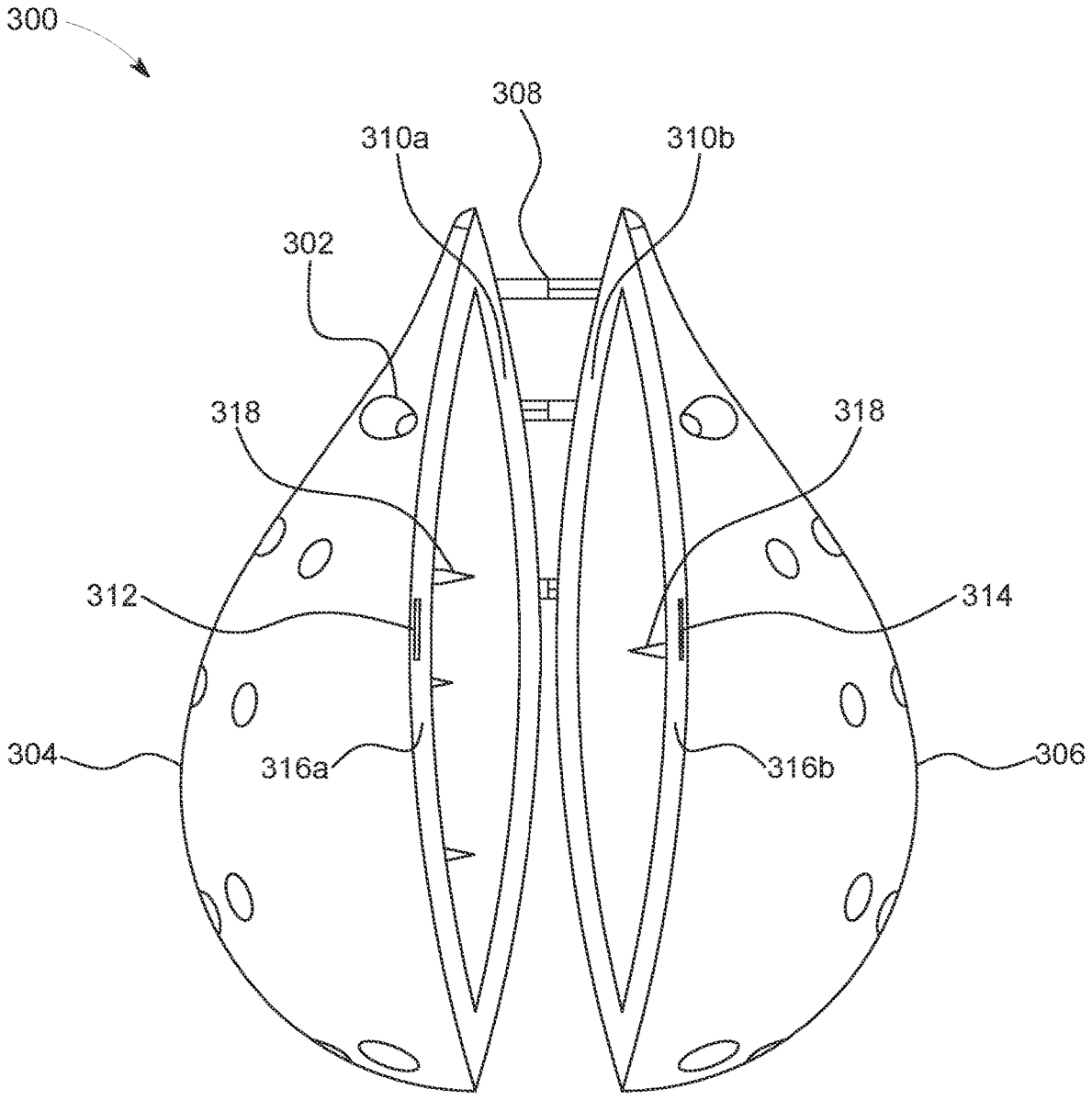
FIG. 3 depicts another example rehydration device with through-holes, in accordance with the present disclosure.

FIG. 3 depicts another example rehydration device 300 with through-holes 302, in accordance with the present disclosure. FIG. 3 illustrates the rehydration device 300 that includes the set of through-holes 302 instead of the gap 202. The through-holes 302 may be configured to allow the flow of the water vapor (e.g., the water vapors that are released from a hemp fabric placed inside the rehydration device 300) out of the rehydration device 300, to maintain the predetermined humidity level in the storage device.

In some aspects, the through-holes 302 may be located on the body portions of a first part 304 and a second part 306 of the rehydration device 300. The first part 304 and the second part 306 may be coupled vertically via a hinge 308. Specifically, the hinge 308 may be located at a first peripheral portion 310*a* of the first part 304, and a first peripheral portion 310*b* of the second part 306.

At the opposite end of the hinge 308, the first part 304 and the second part 306 may be secured in an airtight manner, without any gap, by using a protrusion 312 and a cavity 314. In some aspects, as shown in FIG. 3, the protrusion 312 may be formed in a second peripheral portion 316*a* of the first part 304, and the cavity 314 may be formed in a second peripheral portion 316*b* of the second part 306. Alternatively, the protrusion 312 may be formed in the second peripheral portion 316*b*, and the cavity 314 may be formed in the second peripheral portion 316*a*, without departing from the scope of the present disclosure. In further aspects of the present disclosure, the first part 304 and the second part 306 may be secured in the airtight manner by other fastening means, for example a snap lock.

A personal ordinarily skilled in the art may appreciate that since the rehydration device 300 includes the through-holes 302 to release water vapors out of the rehydration device 300, fins/pins and holes may not be required at the second peripheral portions 316*a*, 316*b* to create a gap (e.g., the gap 202 shown in FIG. 2).

In some aspects, the through-holes 302 may be located on the body portions of both the first part 304 and the second part 306, in a predetermined pattern. For instance, the through-holes 302 may be placed in a linear pattern, a circular pattern, or any other pattern. In some aspects, the through-holes 302 may be equally spaced from each other. In one or more aspects, the predetermined pattern may be selected based on the shape of the rehydration device 300. Similarly, the number of through-holes 302 may be selected based on the shape and size of the rehydration device 300. In further aspects, the number of through-holes 302 on the first part 304 may be same as the number of through-holes 302 on the second part 306. Similarly, the pattern of placement of through-holes 302 in the first part 304 may be same as the pattern in the second part 306. Alternatively, the number or pattern of the through-holes 302 on the first part 304 may be different from the number or pattern of the through-holes 302 in the second part 306.

In some aspects, the number of through-holes 302, and the pattern of arranging the through-holes 302, may be based on the application area of the rehydration device 300.

In one or more aspects, the rehydration device 300 may include one or more retention components 318 to secure the hemp fabric inside the rehydration device 300. The one or more retention components 318 may be same as the one or more retention components 126, 128 described above.

Figure 4:
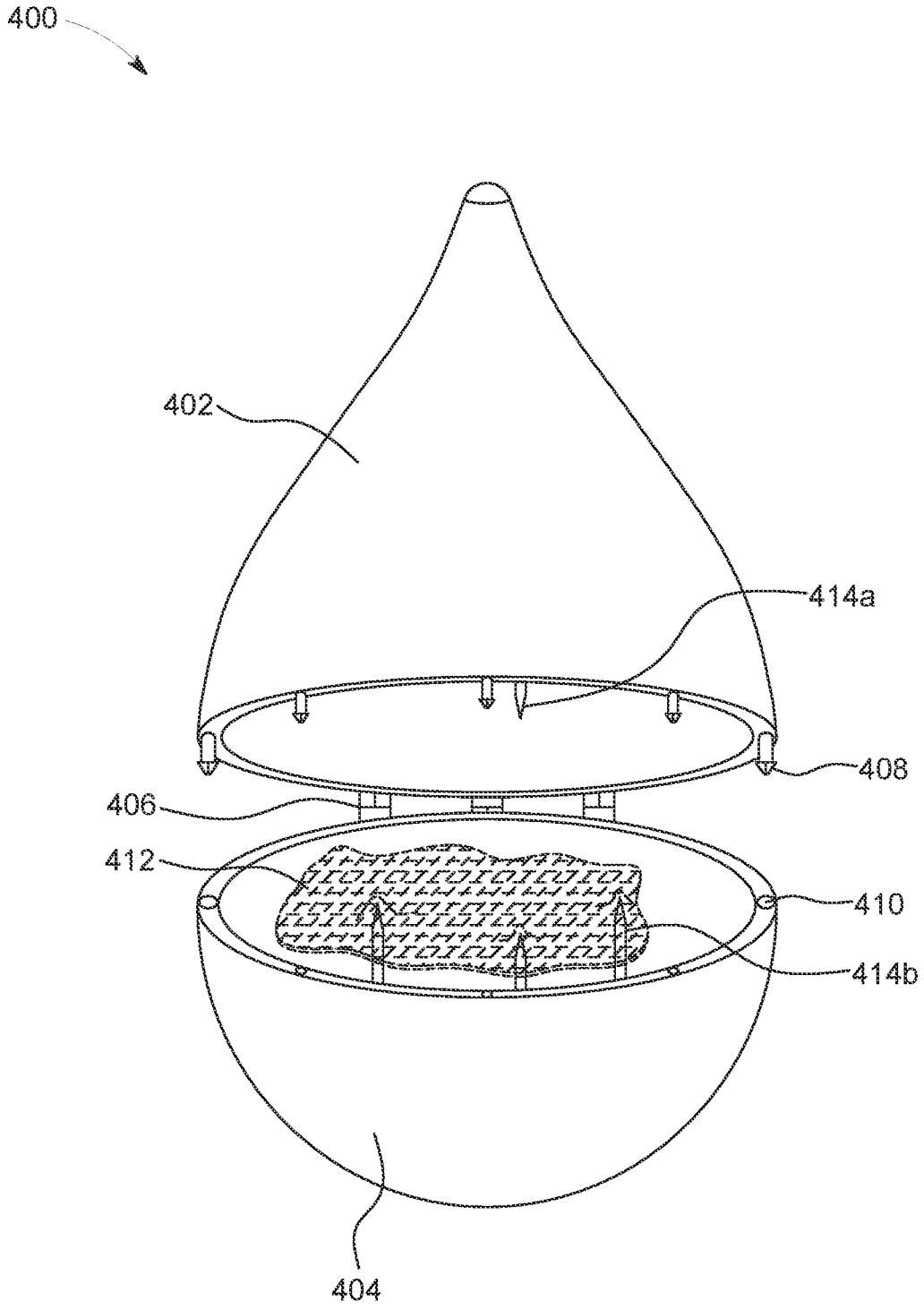
FIG. 4 depicts another example of rehydration device with horizontal hinged mechanism, in accordance with the present disclosure.

FIG. 4 depicts another example rehydration device 400 with a horizontal hinge mechanism, in accordance with the present disclosure. In some aspects, the rehydration device 400 may include a top part 402 and a bottom part 404. In this aspect, the top part 402 and the bottom part 404 may be coupled together via a horizontal hinge 406. The horizontal hinge 406 may be same as the vertical hinge 116 described in conjunction with FIG. 1*a*. In some aspects, the top part 402 and the bottom part 404 may have same heights. In other aspects, the top part 402 and the bottom part 404 may have different heights.

In accordance with further aspects of the present disclosure, the top part 402 and the bottom part 404 may include a locking mechanism that may be same as the locking mechanism described in FIG. 1*a*. For example, the locking mechanism may include a plurality of fins 408 and a plurality of holes 410. In some aspects, the top part 402 may include the plurality of fins 408, and the bottom part 404 may include the plurality of holes 410. Alternatively, the top part 402 may include the plurality of holes 410, and the bottom part 404 may include the plurality of fins 408. The details of the locking mechanism may be understood in conjunction with FIG. 2.

In some aspects, the plurality of fins 408 may be engaged with the plurality of holes 410 to lock or close the rehydration device 400. In particular, in the closed position (e.g., when the plurality of fins 408 are engaged in the plurality of holes 410), a gap (similar to the gap 202, shown in FIG. 2) may be created along the edges of the top part 402 and the bottom part 404. The gap may allow water vapors to flow out of the rehydration device 400.

In accordance with further aspects of the present disclosure, the top part 402 and the bottom part 404 may enclose a hemp fabric 412 (same as the hemp fabric 124 of FIG. 1*b*). In some aspects, the hemp fabric 412 may be arranged in the bottom part 404. In further aspects of the present disclosure, the hemp fabric 412 may be enclosed by using one or more retention components 414*a*, 414*b* (same as the retention components 126, 128 of FIG. 1*a*). In some aspects, the top part 402 may include the one or more retention components 414*a*, and the bottom part 404 may include the one or more retention components 414*b*. For instance, the bottom part 404 may include three securing pins and the top part 402 may include one securing pin, or vice versa.

Figure 5:
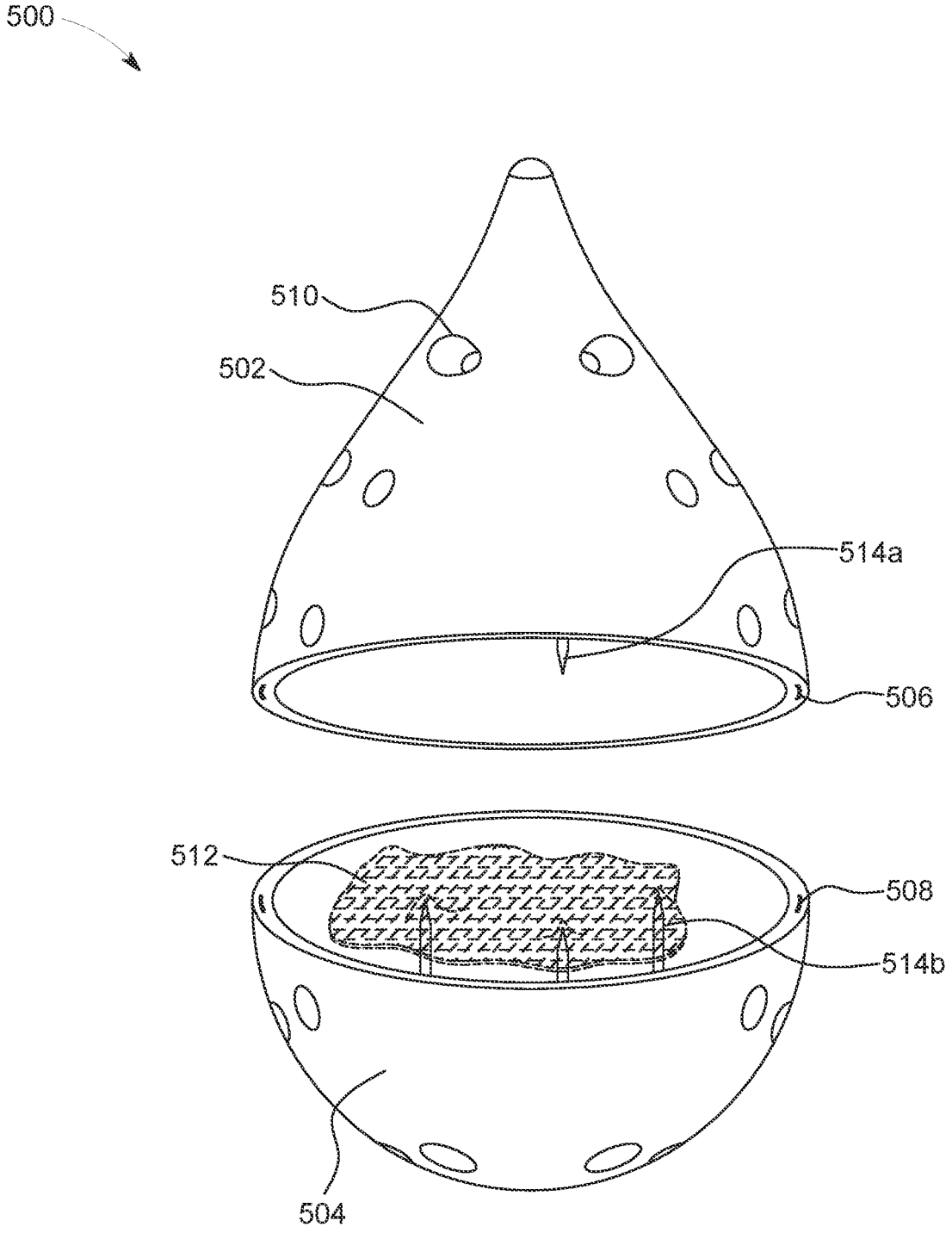
FIG. 5 depicts another example of rehydration device, in accordance with the present disclosure.

FIG. 5 depicts another example rehydration device 500, in accordance with the present disclosure. In particular, the rehydration device 500 may be a "pull-up" kind of device that may include a top part 502 and a bottom part 504 removably coupled with each other. Specifically, the top part 502 may be placed over the bottom part 504, without any hinge mechanism. In particular, in a closed position of the rehydration device 500, the top part 502 may be coupled with the bottom part 504, in an air-tight manner, by using protrusions 506 and cavities 508, formed along the edges of the top part 502 and the bottom part 504, as shown in FIG. 5.

In some aspects, the rehydration device 500 may include a set of through-holes 510. The set of through-holes 510 may be same as the through-holes 302, shown in FIG. 3. In particular, the through-holes 510 may be disposed in both the top part 502 and the bottom part 504. In some aspects, the through-holes 510 may be located only in the top part 502. In one or more aspects, the through-holes 510 may be distributed evenly in the top part 502 and the bottom part 504. In further aspects, the top part 502 and the bottom part 504 may have equal number of through-holes 510. In other aspects, the top part 502 may have more of through-holes 510 as compared to the bottom part 504.

In some aspects, the top part 502 and the bottom part 504 may enclose a hemp fabric 512. In particular, the hemp fabric 512 may be arranged in the bottom part 504. In further aspects of the present disclosure, the hemp fabric 512 may be enclosed by using one or more retention components 514*a*, 514*b*, as described in conjunction with above figures.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, devices, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed devices and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc., should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A rehydration device comprising:

a first part and a second part, wherein each of the first part and the second part comprises a body portion, a first peripheral portion, and a second peripheral portion;

a woven hemp fabric enclosed in the body portion of the first part and the body portion of the second part, wherein the woven hemp fabric is configured to release water vapors to maintain a predefined humidity level in a storage container that is configured to receive the rehydration device;

a hinge located along the first peripheral portion of the first part and the first peripheral portion of the second part, wherein the first part and the second part are configured to rotate about the hinge;

a locking mechanism located along the second peripheral portion of the first part and the second peripheral portion of the second part, wherein the locking mechanism is configured to removably couple the first part and the second part in a closed position of the rehydration device; and one or more openings that extend through the second peripheral portion of the first part and the second peripheral portion of the second part, when the first part and the second part are in the closed position, wherein the locking mechanism comprises a plurality of fins on the second peripheral portion of the first part and a plurality of holes on the second peripheral portion of the second part, and wherein the plurality of fins partially engages with the plurality of holes to create the one or more openings, wherein at least one of the second peripheral portion of the first part and the second peripheral portion of the second part, and the body portion of the first part and the body portion of the second part is configured to allow the water vapors from the woven hemp fabric to flow out of the rehydration device, and wherein the second peripheral portion of the first part and the second peripheral portion of the second part are configured to allow the water vapors from the woven hemp fabric to flow out of the rehydration device via the one or more openings.

2. The rehydration device of claim 1, wherein the body portions of the first part and the second part comprise one or more through-holes.

3. The rehydration device of claim 1, wherein each of the body portion of the first part and the body portion of the second part comprises interior body portion and exterior body portion, wherein the woven hemp fabric is enclosed in the interior body portion of the first part and the interior body portion of the second part.

4. The rehydration device of claim 3, wherein the interior body portion of the first part comprises one or more first retaining components, and the interior body portion of the second part comprises one or more second retaining components to retain the woven hemp fabric in the interior body portion of the first part and the interior body portion of the second part.

5. The rehydration device of claim 4, wherein each of the one or more first retaining components and the one or more second retaining components comprises securing pins or barbs to retain the woven hemp fabric in the interior body portion of the first part and the interior body portion of the second part.

6. The rehydration device of claim 4, wherein the one or more first retaining components of the first part are arranged based on an arrangement of the one or more second retaining components of the second part to retain the woven hemp fabric between the first part and the second part.

7. The rehydration device of claim 1, wherein the rehydration device is a unified piece.

8. The rehydration device of claim 1, wherein the rehydration device is hemi-sphere in shape.

9. The rehydration device of claim 1, wherein the first part and the second part is made of biodegradable plastic.

10. The rehydration device of claim 1, wherein the hinge is made of biodegradable plastic.

11. The rehydration device of claim 1, wherein the woven hemp fabric is anti-fungal and anti-bacterial.

12. The rehydration device of claim 1, wherein the rehydration device is rechargeable using water.

13. A rehydration device comprising:

a first part and a second part, wherein each of the first part and the second part comprises a body portion, a first peripheral portion, and a second peripheral portion;

a woven hemp fabric enclosed in the body portion of the first part and the body portion of the second part, wherein the woven hemp fabric is configured to release water vapors to maintain a predefined humidity level in a storage container that is configured to receive the rehydration device;

a hinge located along the first peripheral portion of the first part and the first peripheral portion of the second part, wherein the first part and the second part are configured to rotate about the hinge; and a locking mechanism located along the second peripheral portion of the first part and the second peripheral portion of the second part, wherein the locking mechanism is configured to removably couple the first part and the second part in a closed position of the rehydration device, wherein the second peripheral portion of the first part and the second peripheral portion of the second part form one or more openings, when the first part and the second part are in the closed position, and wherein the one or more openings are configured to allow the water vapors from the woven hemp fabric to flow out of the rehydration device, wherein the locking mechanism comprises a plurality of fins on the second peripheral portion of the first part and a plurality of holes on the second peripheral portion of the second part, and wherein the plurality of fins partially engages with the plurality of holes to create the one or more openings.

14. The rehydration device of claim 13, wherein each of the body portion of the first part and the body portion of the second part comprises interior body portion and exterior body portion, wherein the woven hemp fabric is enclosed in the interior body portion of the first part and the interior body portion of the second part.

15. The rehydration device of claim 14, wherein the interior body portion of the first part and the interior body portion of the second part comprise one or more retaining components to retain the woven hemp fabric in the interior body portion of the first part and the interior body portion of the second part.

16. The rehydration device of claim 15, wherein the one or more retaining components comprises securing pins or barbs to retain the woven hemp fabric in the interior body portion of the first part and the interior body portion of the second part.

17. The rehydration device of claim 13, wherein the rehydration device is a unified piece.

18. The rehydration device of claim 13, wherein the rehydration device is hemi-sphere in shape.

* * * * *